US011011047B2

(12) United States Patent
Lifshitz et al.

(10) Patent No.: US 11,011,047 B2
(45) **Date of Patent: *May 18, 2021**

(54) SYSTEM AND METHOD FOR AUTOMATICALLY DISARMING AN INTRUSION DETECTION SYSTEM

(71) Applicant: TYCO Fire & Security GMBH, Neuhausen am Rheinfall (CH)

(72) Inventors: Shai Lifshitz, Lapid (IL); Daniel Rettig, Kfar Saba (IL)

(73) Assignee: TYCO Fire & Security GMBH, Neuhausen am Rheinfall (CH)

( * ) Notice: Subject to any disclaimer, the term of this patent is extended or adjusted under 35 U.S.C. 154(b) by 0 days.

This patent is subject to a terminal disclaimer.

(21) Appl. No.: 16/834,793

(22) Filed: Mar. 30, 2020

(65) Prior Publication Data

US 2020/0226911 A1 Jul. 16, 2020

Related U.S. Application Data

(63) Continuation of application No. 15/986,036, filed on May 22, 2018, now Pat. No. 10,672,256.

(60) Provisional application No. 62/512,329, filed on May 30, 2017.

(51) Int. Cl.

| | |
|---|---|
| ***G08B 13/00*** | (2006.01) |
| ***G08B 25/00*** | (2006.01) |
| ***G08B 13/26*** | (2006.01) |
| ***G08B 26/00*** | (2006.01) |

(52) U.S. Cl.

CPC ..... *G08B 25/008* (2013.01); *G08B 13/26* (2013.01); *G08B 25/001* (2013.01); *G08B 26/007* (2013.01)

(58) Field of Classification Search

CPC .... G08B 13/26; G08B 25/001; G08B 25/008; G08B 26/007

USPC ..... 340/541; 370/541

See application file for complete search history.

(56) References Cited

U.S. PATENT DOCUMENTS

| | | | | |
|---|---|---|---|---|
| 8,350,694 | B1 * | 1/2013 | Trundle | G08B 13/00 340/539.11 |
| 2014/0266699 | A1 * | 9/2014 | Poder | G08B 29/185 340/539.13 |
| 2016/0127874 | A1 * | 5/2016 | Kingsmill | H04M 1/7253 455/456.1 |

(Continued)

*Primary Examiner* — Naomi J Small

(74) *Attorney, Agent, or Firm* — Arent Fox LLP

(57) ABSTRACT

A system for automatically disarming an intrusion detection system protecting a premises and having at least an armed state of operation and a disarmed state of operation, the system for automatically disarming the intrusion detection system including an intrusion detection system state of operation ascertainer operable for receiving an indication of activation of an armed state of operation of the intrusion detection system; and a registered mobile communicator proximity detector communicating with the intrusion detection system state of operation ascertainer and operable, responsive to receiving the indication of activation of the armed state of operation by the intrusion detection system state of operation ascertainer for ascertaining at least a subset of a multiplicity of registered mobile communicators which are located in a vicinity of the premises during an activation time of the armed state of operation and for deactivating the subset of the multiplicity of registered mobile communicators.

30 Claims, 9 Drawing Sheets

(56) References Cited

U.S. PATENT DOCUMENTS

| | | | | |
|---|---|---|---|---|
| 2016/0133120 | A1* | 5/2016 | Reibel | G08B 25/008 340/506 |
| 2017/0214584 | A1* | 7/2017 | Kanojia | H04L 41/0816 |
| 2017/0280112 | A1* | 9/2017 | Siminoff | H04N 5/91 |

* cited by examiner

SYSTEM AND METHOD FOR AUTOMATICALLY DISARMING AN INTRUSION DETECTION SYSTEM

RELATED APPLICATIONS

This application is a continuation of U.S. Non-Provisional application Ser. No. 15/986,036, entitled "SYSTEM AND METHOD FOR AUTOMATICALLY DISARMING AN INTRUSION DETECTION SYSTEM" filed May 22, 2018, which claims the benefit under 35 USC 119(e) of U.S. Provisional Application No. 62/512,329, filed May 30, 2017, all of which are incorporated herein by reference in their entirety.

FIELD OF THE INVENTION

The present invention relates generally to automatic disarming of intrusion detection systems.

BACKGROUND OF THE INVENTION

Commercially available intrusion detection systems are typically armed and disarmed by an authorized operator having physical access to a control panel of the intrusion detection system. Such systems are prone to generating false intrusion detection alarms in cases where an authorized operator of the intrusion detection system accesses the premises protected by the intrusion detection system while the system is in an armed state of operation, while neglecting to first manually disarm the intrusion detection system. The present invention provides a method and system for automatically disarming an intrusion detection system.

SUMMARY OF THE INVENTION

The present invention seeks to provide a system and method for automatically disarming an intrusion detection system.

There is thus provided in accordance with a preferred embodiment of the present invention a system for automatically disarming an intrusion detection system, the intrusion detection system protecting a premises and having at least an armed state of operation and a disarmed state of operation, the system for automatically disarming the intrusion detection system including an intrusion detection system state of operation ascertainer operable, for receiving at least an indication of activation of an armed state of operation of the intrusion detection system; an intrusion detection indication receiver operable for receiving an indication of detection of an intrusion to the premises; a registered mobile communicator proximity detector communicating with the intrusion detection system state of operation ascertainer and with the intrusion detection indication receiver and operable, responsive to the receiving the indication of the activation of the armed state of operation of the intrusion detection system, for deactivating at least a subset of a multiplicity of registered mobile communicators which are located in a vicinity of the premises during an activation time of the armed state of operation, the registered mobile communicator proximity detector also being operable, responsive to the receiving the indication of the activation of the armed state of operation of the intrusion detection system and to the receiving the indication of the detection of the intrusion to the premises, for ascertaining whether at least one of the registered mobile communicators which is not a member of the deactivated subset of registered mobile communicators is in a vicinity of the premises; and an automatic intrusion detection system disarmer communicating with the registered mobile communicator proximity detector and operable, responsive to the ascertaining that at least one of the registered mobile communicators which is not a member of the deactivated subset of registered mobile communicators is in the vicinity of the premises, for automatically disarming the intrusion detection system.

There is also provided in accordance with another preferred embodiment of the present invention, for use in a system for automatically disarming an intrusion detection system, the intrusion detection system protecting a premises and having at least an armed state of operation and a disarmed state of operation, a subsystem including an intrusion detection system state of operation ascertainer operable, for receiving, from the intrusion detection system, at least an indication of activation of an armed state of operation of the intrusion detection system; and a registered mobile communicator proximity detector communicating with the intrusion detection system state of operation ascertainer and operable, responsive to receiving the indication of the activation of the armed state of operation of the intrusion detection system by the intrusion detection system state of operation ascertainer for ascertaining at least a subset of a multiplicity of registered mobile communicators which are located in a vicinity of the premises during an activation time of the armed state of operation and for deactivating the subset of the multiplicity of registered mobile communicators.

Preferably, the system also comprises an intrusion detection indication receiver communicating with the registered mobile communicator proximity detector and operable for receiving an indication of detection of an intrusion to the premises from the intrusion detection system, and the registered mobile communicator proximity detector is also operable, responsive to receiving the indication of the activation of the armed state of operation of the intrusion detection system by the intrusion detection system state of operation ascertainer and to receiving the indication of the detection of the intrusion to the premises by the intrusion detection indication receiver, for ascertaining whether at least one of the registered mobile communicators which is not a member of the deactivated subset of registered mobile communicators is in a vicinity of the premises.

Preferably, the system also includes an automatic intrusion detection system disarmer communicating with the registered mobile communicator proximity detector and operable, responsive to receiving the indication of the activation of the armed state of operation of the intrusion detection system by the intrusion detection system state of operation ascertainer, to receiving the indication of the detection of the intrusion to the premises by the intrusion detection indication receiver, and to ascertaining that at least one of the registered mobile communicators which is not a member of the deactivated subset of registered mobile communicators is in the vicinity of the premises, for automatically disarming the intrusion detection system.

Preferably, the activation time of the armed state of operation includes a finite activation period of time starting at the receipt of the indication of the activation of the armed state of operation of the intrusion detection system. Preferably, the registered mobile communicator proximity detector is operable responsive to receiving the indication of activation of the armed state of operation of the intrusion detection system, for deactivating all of the registered mobile communicators; for continuously ascertaining, during the activation time, for each the deactivated mobile communicator, whether the deactivated mobile communicator is in a vicinity of the premises; and, responsive to ascertaining that the deactivated mobile communicator is not in a vicinity of the premises during at least part of the activation time, for reactivating the deactivated mobile communicator.

Preferably, the system for automatically disarming an intrusion detection system also includes a deactivated mobile communicator ascertainer operable for querying, at the end of the activation time, an operator of each deactivated mobile communicator of the deactivated subset of the multiplicity of registered mobile communicators, whether to reactivate the deactivated mobile communicator and, responsive to receiving confirmation from the operator of the deactivated mobile communicator, for reactivating the deactivated mobile communicator.

Preferably, the registered mobile communicator proximity detector is also operable, responsive to receiving the indication of detection of the intrusion to the premises from the intrusion detection system in the armed state of operation and responsive to ascertaining that none of the multiplicity of registered mobile communicators which are not members of the deactivated subset of mobile communicators are in the vicinity of the premises, for generating an intrusion indication indicative of the intrusion.

Preferably, receiving, by the intrusion detection system state of operation ascertainer from the intrusion detection system, the indication of activation of the armed state of operation of the intrusion detection system includes communicating between the intrusion detection system and the intrusion detection system state of operation ascertainer over the PowerG communication protocol.

Preferably, the multiplicity of mobile communicators are registered with the registered mobile communicator proximity detector for automatically disarming the intrusion detection system via Bluetooth Low Energy (BLE) bonding. Preferably, ascertaining, by the registered mobile communicator proximity detector, the at least the subset of the multiplicity of registered mobile communicators which are located in the vicinity of the premises during the activation time of the armed state of operation includes employing, by the registered mobile communicator proximity detector, the Bluetooth Low Energy (BLE) communication protocol to scan the vicinity of the premises for the multiplicity of registered mobile communicators. Preferably, ascertaining, by the registered mobile communicator proximity detector, whether the at least one of the registered mobile communicators which is not a member of the deactivated subset of registered mobile communicators is in the vicinity of the premises includes employing, by the registered mobile communicator proximity detector, the Bluetooth Low Energy (BLE) communication protocol to scan the vicinity of the premises for the multiplicity of registered mobile communicators which are not members of the deactivated subset of registered mobile communicators.

Preferably, automatically disarming the intrusion detection system by the automatic intrusion detection system disarmer includes establishing a connection between the automatic intrusion detection system disarmer and the at least one registered mobile communicator which is not a member of the deactivated subset of registered mobile communicators; communicating, by the automatic intrusion detection system disarmer to the at least one registered mobile communicator an indication that the intrusion detection system is in the armed state of operation; responsive to receiving the indication that the intrusion detection system is in the armed state of operation, communicating, by the at least one registered mobile communicator to the automatic intrusion detection system disarmer, an instruction to disarm the intrusion detection system; and, responsive to receiving the instruction to disarm the intrusion detection system by the automatic intrusion detection system disarmer, forwarding, by the automatic intrusion detection system disarmer to the intrusion detection system, the instruction to disarm the intrusion detection system.

Preferably, automatically disarming the intrusion detection system by the automatic intrusion detection system disarmer further includes responsive to receiving, by the intrusion detection system, the instruction to disarm the intrusion detection system, disarming the intrusion detection system by the intrusion detection system; responsive to disarming the intrusion detection system by the intrusion detection system, communicating, by the intrusion detection system to the automatic intrusion detection system disarmer, an indication of the disarming of the intrusion detection system by the intrusion detection system; and forwarding, by the automatic intrusion detection system disarmer to the at least one registered mobile communicator, the indication of the disarming of the intrusion detection system by the intrusion detection system.

Preferably, the connection between the automatic intrusion detection system disarmer and the at least one registered mobile communicator which is not a member of the deactivated subset of registered mobile communicators is a Bluetooth Low Energy (BLE) connection. Preferably, communicating, between the at least one registered mobile communicator and the automatic intrusion detection system disarmer, is over the PowerG protocol.

There is also provided in accordance with yet another preferred embodiment of the present invention a method for automatically disarming an intrusion detection system, the intrusion detection system protecting a premises and having at least an armed state of operation and a disarmed state of operation, the method including receiving at least an indication of activation of an armed state of operation of the intrusion detection system; receiving an indication of detection of an intrusion to the premises; responsive to the receiving the indication of the activation of the armed state of operation of the intrusion detection system deactivating at least a subset of a multiplicity of registered mobile communicators which are located in a vicinity of the premises during an activation time of the armed state of operation; and responsive to the receiving the indication of the activation of the armed state of operation of the intrusion detection system and to the receiving the indication of detection of the intrusion to the premises ascertaining whether at least one of the registered mobile communicators which is not a member of the deactivated subset of registered mobile communicators is in a vicinity of the premises; and responsive to the ascertaining that at least one of the registered mobile communicators which is not a member of the deactivated subset of registered mobile communicators is in the vicinity of the premises, automatically disarming the intrusion detection system.

There is also provided in accordance with another preferred embodiment of the present invention, for use in a method for automatically disarming an intrusion detection system, the intrusion detection system protecting a premises and having at least an armed state of operation and a disarmed state of operation, a submethod including receiving, from the intrusion detection system, at least an indication of activation of an armed state of operation of the intrusion detection system and, responsive to receiving the indication of activation of the armed state of operation of the intrusion detection system ascertaining at least a subset of a multiplicity of registered mobile communicators which are located in a vicinity of the premises during an activation time of the armed state of operation and deactivating the subset of the multiplicity of registered mobile communicators.

Preferably, the method also includes, responsive to receiving, from the intrusion detection system, the indication of the activation of the armed state of operation of the intrusion detection system and receiving an indication of detection of an intrusion to the premises from the intrusion detection system, ascertaining whether at least one of the registered mobile communicators which is not a member of the deactivated subset of registered mobile communicators is in a vicinity of the premises.

Preferably, the method also includes, responsive to receiving from the intrusion detection system, the indication of the activation of the armed state of operation of the intrusion detection system, to receiving the indication of the detection of the intrusion to the premises from the intrusion detection system, and to ascertaining that at least one of the registered mobile communicators which is not a member of the deactivated subset of registered mobile communicators is in the vicinity of the premises, automatically disarming the intrusion detection system.

Preferably, the activation time of the armed state of operation includes a finite activation period of time starting at the receipt of the indication of the activation of the armed state of operation of the intrusion detection system.

Preferably, deactivating the at least a subset of a multiplicity of registered mobile communicators includes responsive to receiving the indication of activation of the armed state of operation of the intrusion detection system, deactivating all of the registered mobile communicators; continuously ascertaining, during the activation time, for each the deactivated mobile communicator, whether the deactivated mobile communicator is in a vicinity of the premises; and, responsive to ascertaining that the deactivated mobile communicator is not in the vicinity of the premises during at least part of the activation time, reactivating the deactivated mobile communicator.

Preferably, the method also includes querying, at the end of the activation time, an operator of each of the deactivated mobile communicator of the deactivated subset of the multiplicity of registered mobile communicators whether to reactivate the deactivated mobile communicator and, responsive to receiving confirmation from the operator of the deactivated mobile communicator, reactivating the deactivated mobile communicator.

Preferably, the method also includes, responsive to receiving the indication of detection of the intrusion to the premises from the intrusion detection system in the armed state of operation and responsive to ascertaining that none of the multiplicity of registered mobile communicators which are not members of the deactivated subset of mobile communicators are in the vicinity of the premises, generating an intrusion indication indicative of the intrusion.

Preferably, receiving the indication of activation of the armed state of operation of the intrusion detection system includes communicating, by the intrusion detection system, the state of operation of the intrusion detection system over the PowerG communication protocol.

Preferably, the multiplicity of registered mobile communicators are registered via Bluetooth Low Energy (BLE) bonding. Preferably, ascertaining the at least the subset of the multiplicity of registered mobile communicators which are located in the vicinity of the premises during the activation time of the armed state of operation includes employing the Bluetooth Low Energy (BLE) communication protocol to scan the vicinity of the premises for the multiplicity of registered mobile communicators. Preferably, the ascertaining whether the at least one of the registered mobile communicators which is not a member of the deactivated subset of registered mobile communicators is in the vicinity of the premises includes employing the Bluetooth Low Energy (BLE) communication protocol to scan the vicinity of the premises for the multiplicity of registered mobile communicators which are not members of the deactivated subset of registered mobile communicators.

Preferably, automatically disarming the intrusion detection system includes establishing a connection with at least one of the registered mobile communicators which is not a member of the deactivated subset of registered mobile communicators; communicating to the at least one registered mobile communicator, over the connection, an indication that the intrusion detection system is in the armed state of operation; responsive to receiving the indication that the intrusion detection system is in the armed state of operation, communicating, by the at least one registered mobile communicator, over the connection, an instruction to disarm the intrusion detection system; and, responsive to receiving the instruction to disarm the intrusion detection system, forwarding, to the intrusion detection system, the instruction to disarm the intrusion detection system.

Preferably, automatically disarming the intrusion detection system further includes responsive to receiving, by the intrusion detection system, the instruction to disarm the intrusion detection system, disarming the intrusion detection system; responsive to disarming the intrusion detection system, communicating, by the intrusion detection system, an indication of the disarming of the intrusion detection system; and forwarding, to the at least one registered mobile communicator, over the connection, the indication of the disarming of the intrusion detection system.

Preferably, the connection with the at least one of the registered mobile communicators which is not a member of the deactivated subset of registered mobile communicators is a Bluetooth Low Energy (BLE) connection. Preferably, the communication with the intrusion detection system is over the PowerG protocol.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Reference is now made to FIGS. 1, 2A, 2B, 3A, 3B and 3C which are simplified illustrations of the operation of alternative embodiments of an automatic intrusion system disarming system, constructed and operative in accordance with preferred embodiments of the present invention.

Figure 1:
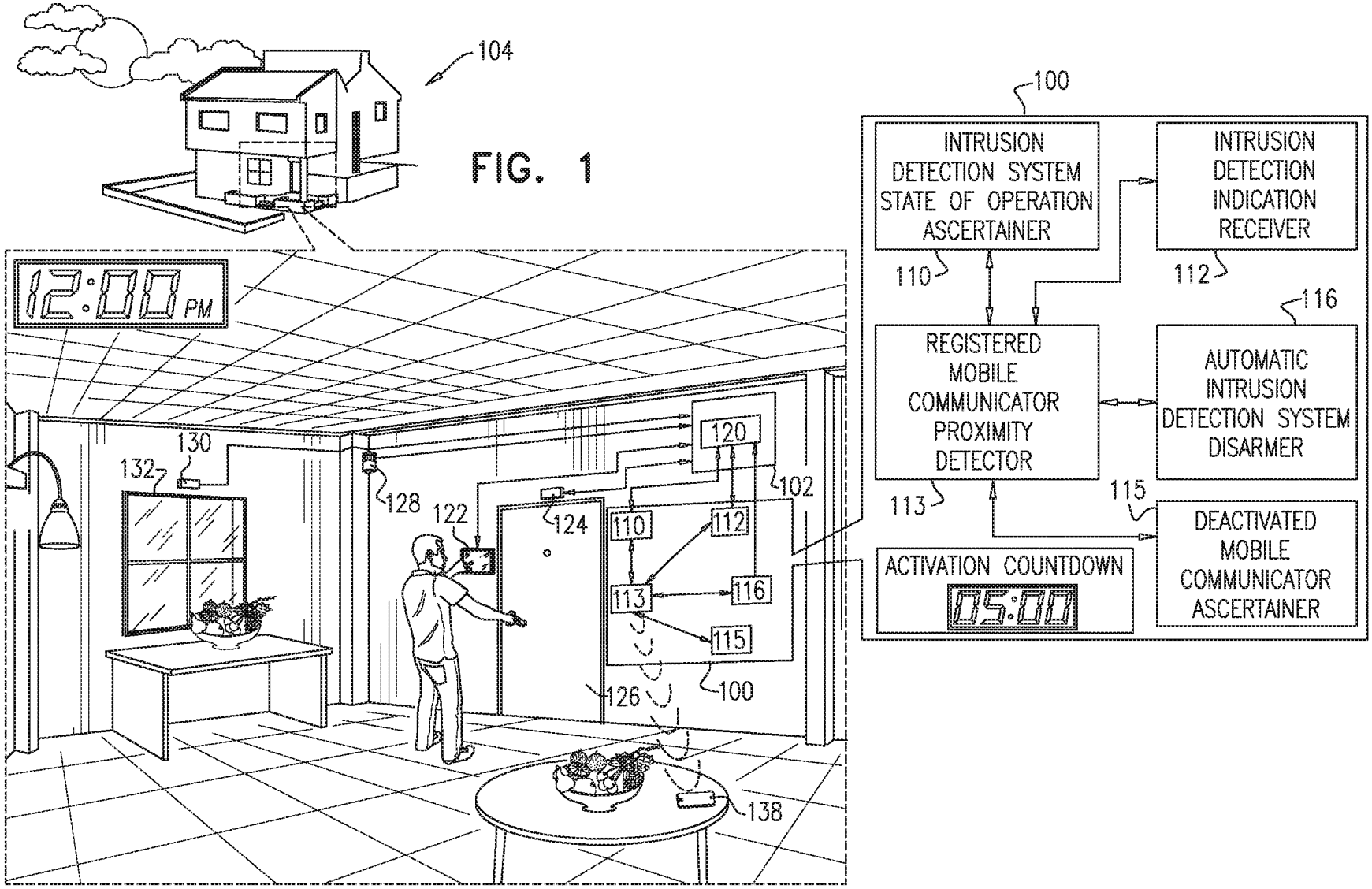
FIG. 1 is a simplified illustration of steps in the operation of a first embodiment of an automatic intrusion system disarming system, constructed and operative in accordance with a preferred embodiment of the present invention.

As shown in FIG. 1, there is provided an automatic intrusion system disarming system 100 operable for automatically disarming an intrusion detection system 102 protecting a premises 104, intrusion detection system 102 preferably having at least an armed state of operation and a disarmed state of operation. It is appreciated that intrusion detection system 102 may have additional states of operation.

Automatic intrusion system disarming system 100 preferably includes an intrusion detection system state of operation ascertainer 110 operable for receiving, from intrusion detection system 102, an indication of activation of an armed state of operation of intrusion detection system 102. It is appreciated that intrusion detection system state of operation ascertainer 110 may also be operable for receiving, from intrusion detection system 102, an indication of activation of a disarmed state of operation of intrusion detection system 102.

Automatic intrusion system disarming system 100 preferably also includes an intrusion detection indication receiver 112 operable for receiving, from intrusion detection system 102, an indication of detection of an intrusion to premises 104.

A registered mobile communicator proximity detector 113 is preferably provided for communicating with intrusion detection system state of operation ascertainer 110 and with intrusion detection indication receiver 112 and is preferably operable, responsive to receiving an indication of activation of the armed state of operation of intrusion detection system 102, for ascertaining at least a subset of a multiplicity of registered mobile communicators which are located in a vicinity of premises 104 during an activation time of the armed state of operation of intrusion detection system 102 and for deactivating the subset of located multiplicity of registered mobile communicators. It is appreciated that the activation time of the armed state of operation preferably comprises a finite activation period of time starting at the receipt of the indication of the activation of the armed state of operation of intrusion detection system 102.

As will be described hereinbelow, the mobile communicators of individuals authorized to access the premises are preferably pre-registered with registered mobile communicator proximity detector 113 and are preferably operable for automatically disarming intrusion detection system 102 when in the vicinity thereof. It is appreciated that the registered mobile communicators are preferably registered with registered mobile communicator proximity detector 113 via Bluetooth Low Energy (BLE) bonding.

It is a particular feature of the present invention that registered mobile communicators located in the vicinity of premises 104 at the time of activation of the armed state of operation of intrusion detection system 102 are preferably deactivated by registered mobile communicator proximity detector 113 and, in the deactivated state, are no longer operable for automatically disarming intrusion detection system 102 when in the vicinity thereof This feature of system 100 prevents mobile communicators residing in premises 104 during an activation time of the armed state of operation of intrusion detection system 102, such as by being accidentally left in premises 104 by an individual leaving premises 104 and activating intrusion detection system 102, from immediately automatically disarming intrusion detection system 102.

In particular, registered mobile communicator proximity detector 113 is operable, responsive to receiving the indication of activation of the armed state of operation of intrusion detection system 102, for initially deactivating all registered mobile communicators. Thereafter, registered mobile communicator proximity detector 113 continuously ascertains, during the finite activation period of time, for each deactivated mobile communicator, whether the deactivated mobile communicator is in a vicinity of premises 104 and, responsive to ascertaining that the deactivated mobile communicator is not in a vicinity of premises 104 during at least part of the finite activation period of time, for reactivating the deactivated mobile communicator. It is appreciated that ascertaining, by mobile communicator proximity detector 113, whether a registered mobile communicator is in the vicinity of premises 104 preferably includes employing the Bluetooth Low Energy (BLE) wireless communication protocol to scan the vicinity of premises 104 for the presence of the registered mobile communicator.

Registered mobile communicator proximity detector 113 is preferably further operable, responsive to receiving an indication of detection of an intrusion to premises 104, for ascertaining whether at least one of the registered mobile communicators which is not a member of the deactivated subset of registered mobile communicators is in a vicinity of premises 104. As described hereinabove, ascertaining, by registered mobile communicator proximity detector 113, whether a registered mobile communicator is in the vicinity of premises 104 preferably includes employing the Bluetooth Low Energy (BLE) wireless communication protocol to scan the vicinity of premises 104 for the presence of the registered mobile communicator.

Automatic intrusion system disarming system 100 also preferably includes a deactivated mobile communicator ascertainer 115, communicating with registered mobile communicator proximity detector 113, and operable for querying, at the end of the finite activation period of time, an operator of each deactivated mobile communicator of the deactivated subset of the multiplicity of registered mobile communicators, whether to reactivate the deactivated mobile communicator and, responsive to receiving confirmation from the operator of the deactivated mobile communicator, for reactivating the deactivated mobile communicator.

Automatic intrusion system disarming system 100 yet further preferably includes an automatic intrusion detection system disarmer 116 communicating with registered mobile communicator proximity detector 113 and operable, responsive to ascertaining, by registered mobile communicator proximity detector 113 that at least one of the multiplicity of mobile communicators registered with automatic intrusion system disarming system 100 which is not a member of the deactivated subset of registered mobile communicators is in the vicinity of the premises, for automatically disarming intrusion detection system 100.

Intrusion detection system 102 typically includes a controller 120 operable for controlling intrusion detection system 102. Controller 120 may, for example, be manually accessible to an operator of intrusion detection system 102 via a user interface 122 or remotely accessible such as by employing a suitable communicator device such as a mobile telephone. It is appreciated that controller 120 is preferably operable, responsive to receiving a suitable instruction, for switching the state of operation of intrusion detection system 102 between an armed state of operation and a disarmed state of operation. Controller 120 is also preferably operable for providing an indication of a current state of operation of intrusion detection system 102.

Intrusion detection system 102 also typically includes a multiplicity of sensors operable for detecting intrusions to various parts of premises 104. These sensors may include, for example, a magnetic contact sensor 124 mounted on a front door 126 of premises 104, operable for detecting opening of front door 126. Additional sensors may include, for example, motion sensors 128 operable for detecting motion inside premises 104 or in the vicinity of premises 104 and a contact sensor 130 mounted on a window 132 of premises 104 operable for detecting opening of window 132.

As illustrated in FIG. 1, an individual approaches front door 126 from within premises 104 and, prior to exiting premises 104, preferably activates an armed state of operation of intrusion detection system 102 by employing, for example, user interface 122. Responsive to activation of the armed state of operation, intrusion detection system 102 preferably provides an indication of activation of the armed state of operation of intrusion detection system 102 to intrusion detection system state of operation ascertainer 110.

As described hereinabove, registered mobile communicator proximity detector 113, communicating with intrusion detection system state of operation ascertainer 110, is preferably operable, responsive to receiving the indication of activation of the armed state of operation of intrusion detection system 102 by intrusion detection system state of operation ascertainer 110, for initially deactivating all registered mobile communicators. Thereafter, registered mobile communicator proximity detector 113 continuously ascertains, during the finite activation period of time, for each deactivated mobile communicator, whether the deactivated mobile communicator is in a vicinity of premises 104 and, responsive to ascertaining that the deactivated mobile communicator is not in a vicinity of premises 104 during at least part of the finite activation period of time, for reactivating the deactivated mobile communicator. It is appreciated that ascertaining, by mobile communicator proximity detector 113, whether a registered mobile communicator is in the vicinity of premises 104 preferably includes employing the Bluetooth Low Energy (BLE) wireless communication protocol to scan the vicinity of premises 104 for the presence of the registered mobile communicator.

As illustrated in FIG. 1, a registered mobile communicator 138, accidentally left in premises 104 by one of the residents of premises 104 is detected by registered mobile communicator proximity detector 113 at the time of activation of the armed state of operation of intrusion detection system 102 and is therefore not reactivated.

Figure 2A:
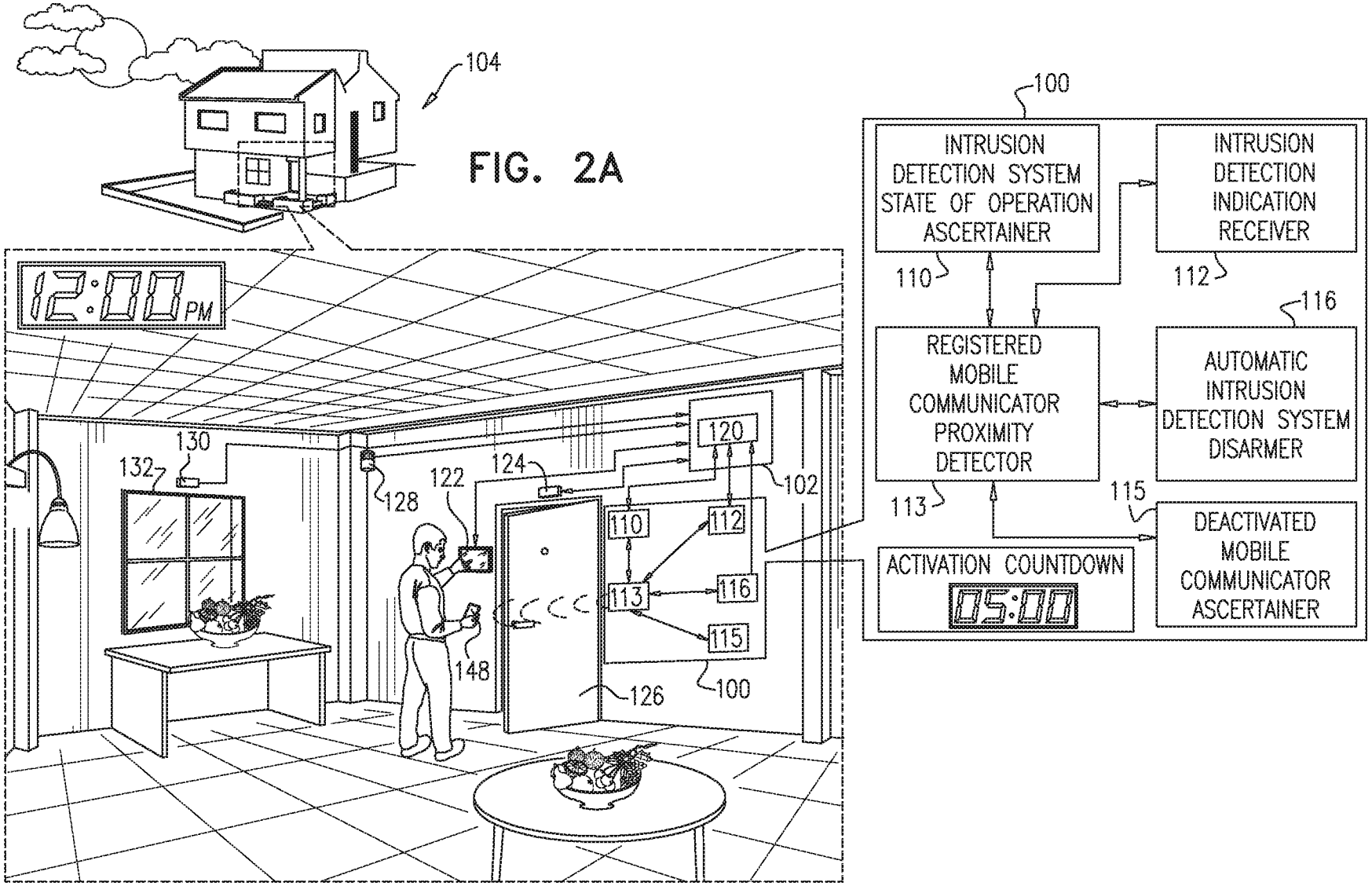
FIGS. 2A and 2B are simplified illustrations of steps in the operation of an alternative embodiment of the automatic intrusion system disarming system of FIG. 1.
Figure 2B:
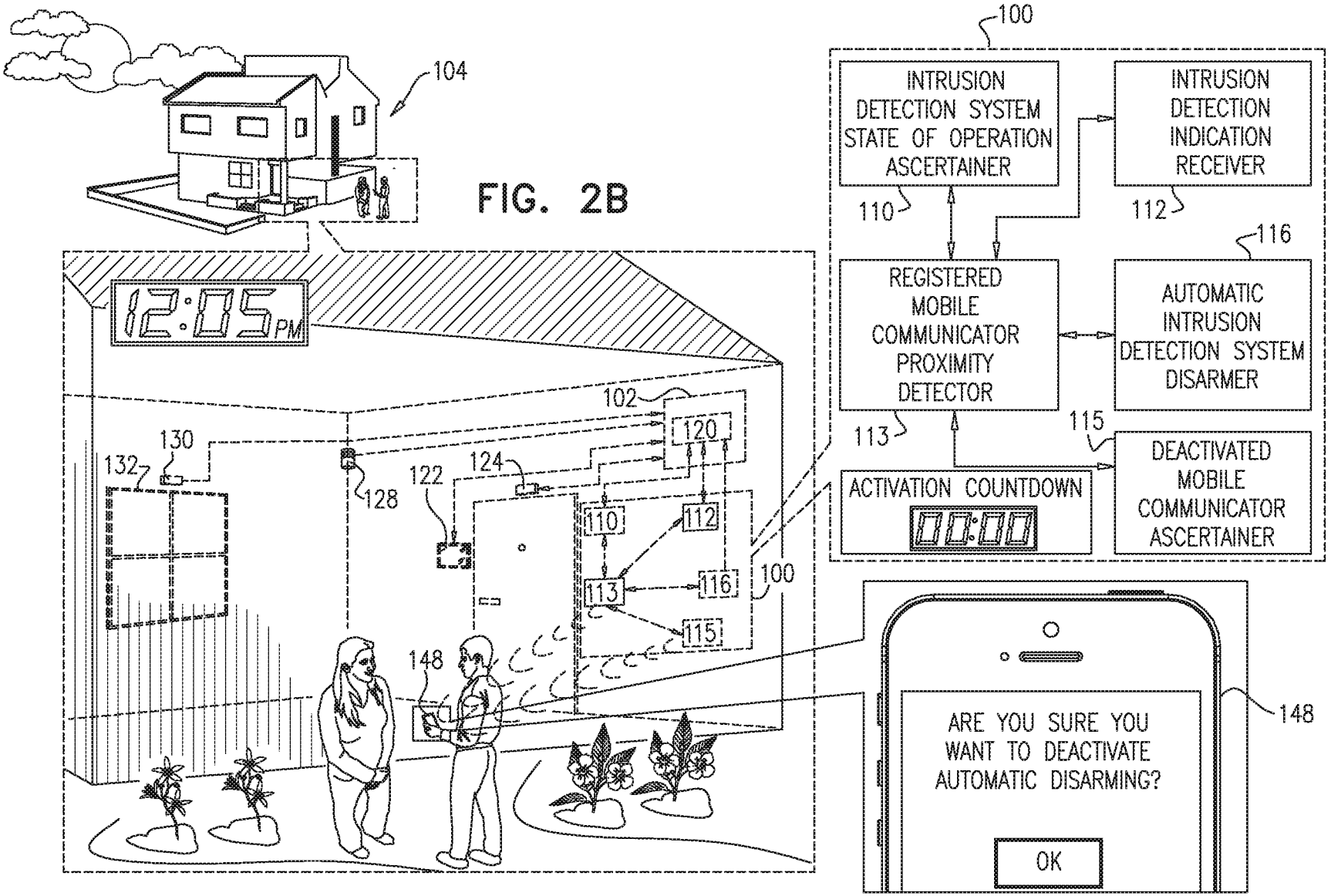

In an alternative embodiment illustrated in FIGS. 2A & 2B, an individual holding a registered mobile communicator 148 approaches front door 126 from within premises 104 and, prior to exiting premises 104, preferably activates an armed state of operation of intrusion detection system 102 by employing, for example, user interface 122. Responsive to activation of the armed state of operation, intrusion detection system 102 preferably provides an indication of activation of the armed state of operation of intrusion detection system 102 to intrusion detection system state of operation ascertainer 110.

As described hereinabove, registered mobile communicator proximity detector 113, communicating with intrusion detection system state of operation ascertainer 110, is preferably operable, responsive to receiving the indication of activation of the armed state of operation of intrusion detection system 102 by intrusion detection system state of operation ascertainer 110, for initially deactivating registered mobile communicator 148. Thereafter, registered mobile communicator proximity detector 113 continuously ascertains, during the finite activation period of time, whether deactivated mobile communicator 148 is in a vicinity of premises 104 and, responsive to ascertaining that deactivated mobile communicator 148 is not in a vicinity of premises 104 during at least part of the finite activation period of time, for reactivating deactivated mobile communicator 148. It is appreciated that ascertaining, by mobile communicator proximity detector 113, whether registered mobile communicator 148 is in the vicinity of premises 104 preferably includes employing the Bluetooth Low Energy (BLE) wireless communication protocol to scan the vicinity of premises 104 for the presence of registered mobile communicator 148.

As illustrated in FIG. 2B, after exiting premises 104, the individual meets a neighbor with whom he chats for several minutes. Due to the proximity of the individual to premesis throughout the time of activation of the armed state of operation of intrusion detection system 102, registered mobile communicator 148, held by the individual, is detected by registered mobile communicator proximity detector 113 during the time of activation of the armed state of operation of intrusion detection system 102 and, as described hereinabove, is therefore not reactivated. It is appreciated that in the example of the embodiment of FIGS. 2A & 2B, although registered mobile communicator 148 is in the vicinity of premises 104 during the time of activation of the armed state of operation, it is reasonable to assume that the individual does not desire deactivation of registered mobile communicator 148, and that the individual would prefer to employ registered mobile communicator 148 to automatically disarm intrusion detection system 102 upon his future return to premises 104. To ascertain that this is indeed the intention of the individual, deactivated mobile communicator ascertainer 115 preferably queries the individual, at the end of the finite activation period of time, whether to reactivate the deactivated mobile communicator. It is appreciated that the query may be sent, for example, in the form of a prompt which is displayed to the individual on a screen of mobile communicator 148, communicated thereto over a Bluetooth Low Energy (BLE) wireless connection established between deactivated mobile communicator ascertainer 115 and mobile communicator 148. Responsive to receiving confirmation from the individual via mobile communicator 148, deactivated mobile communicator ascertainer 115 preferably reactivates the deactivated mobile communicator.

Figure 3A:
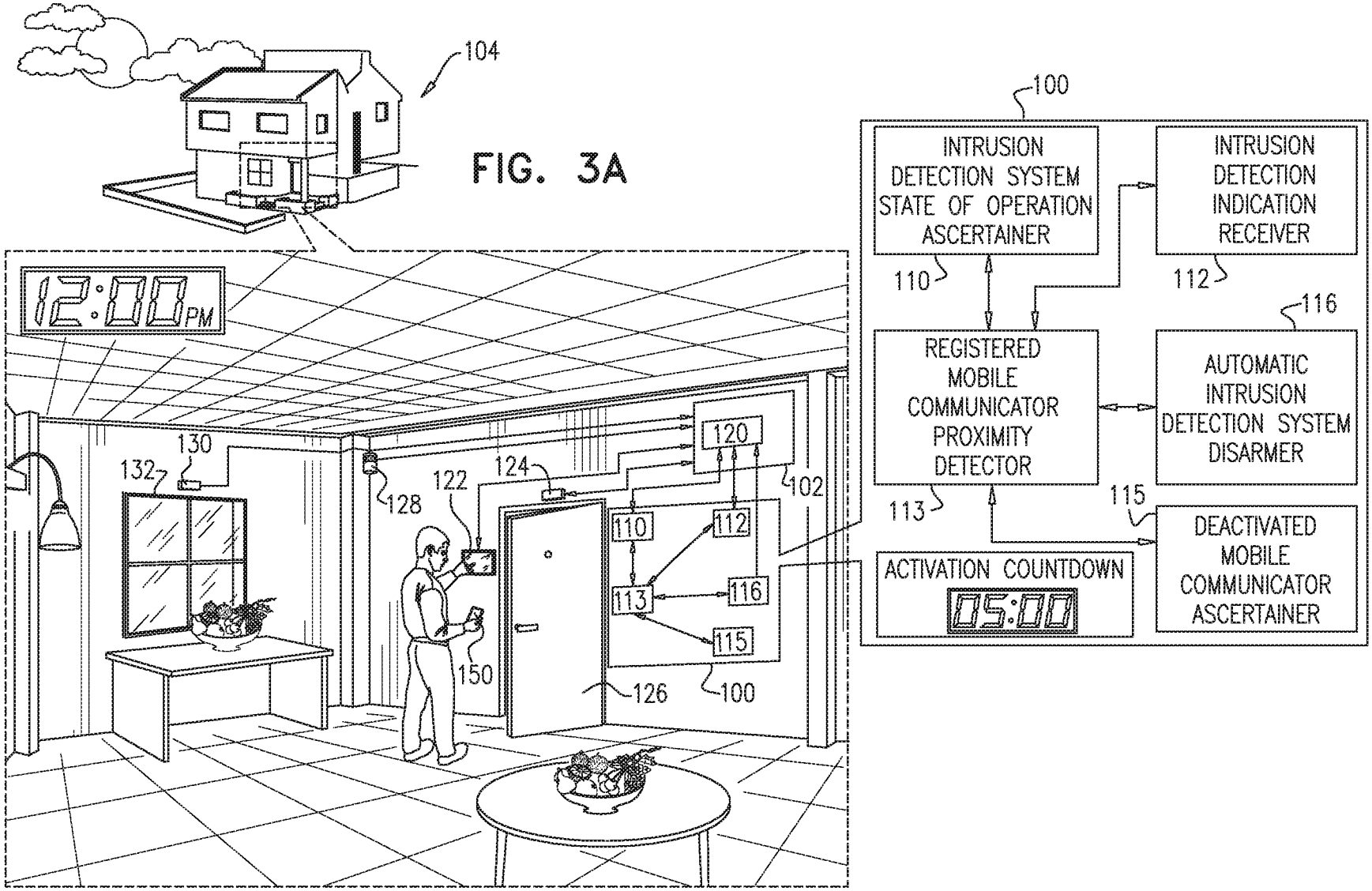
FIGS. 3A, 3B and 3C are simplified illustrations of steps in the operation of another alternative embodiment of the automatic intrusion system disarming system of FIGS. 1-2B.
Figure 3B:
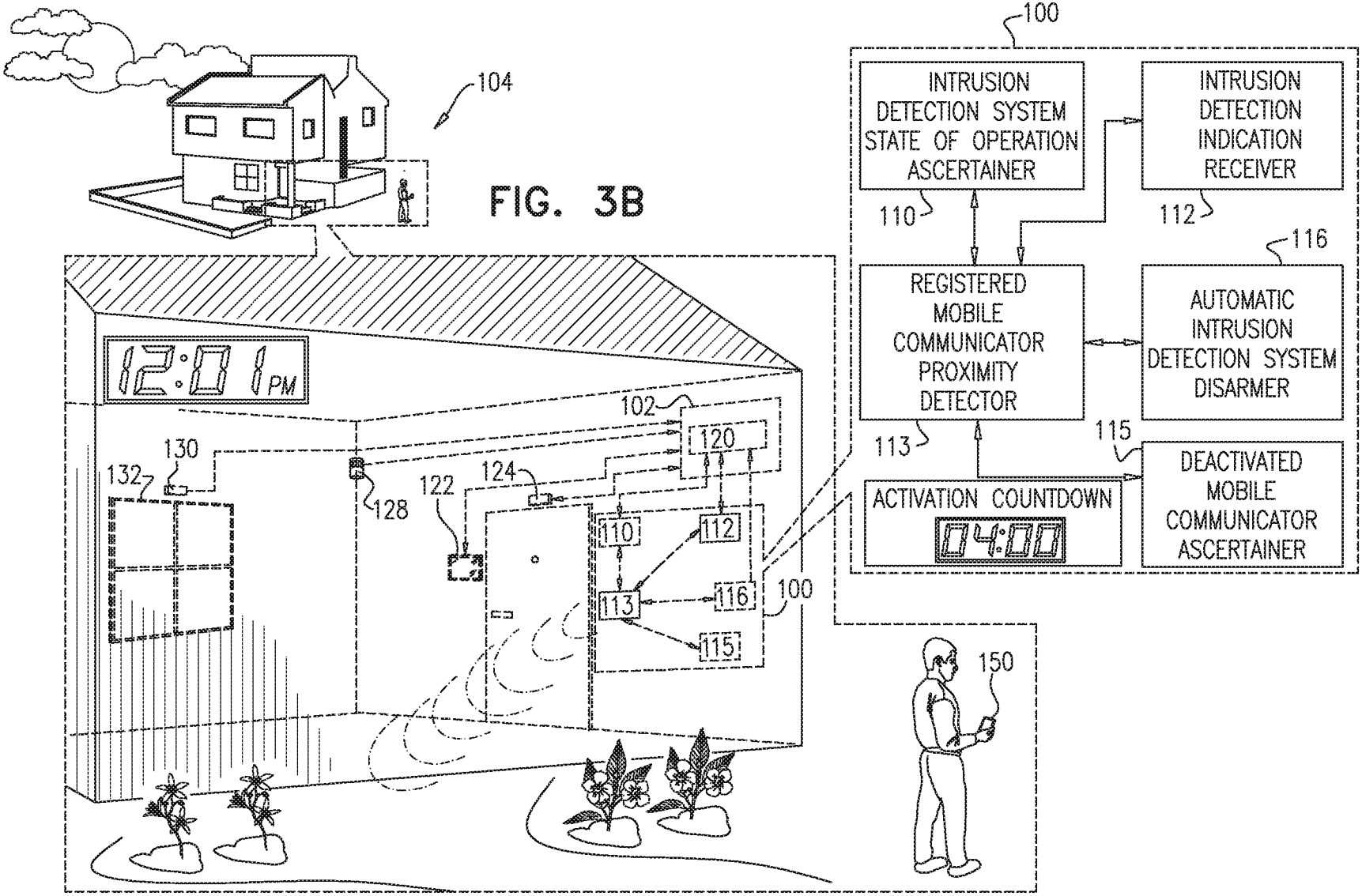
Figure 3C:
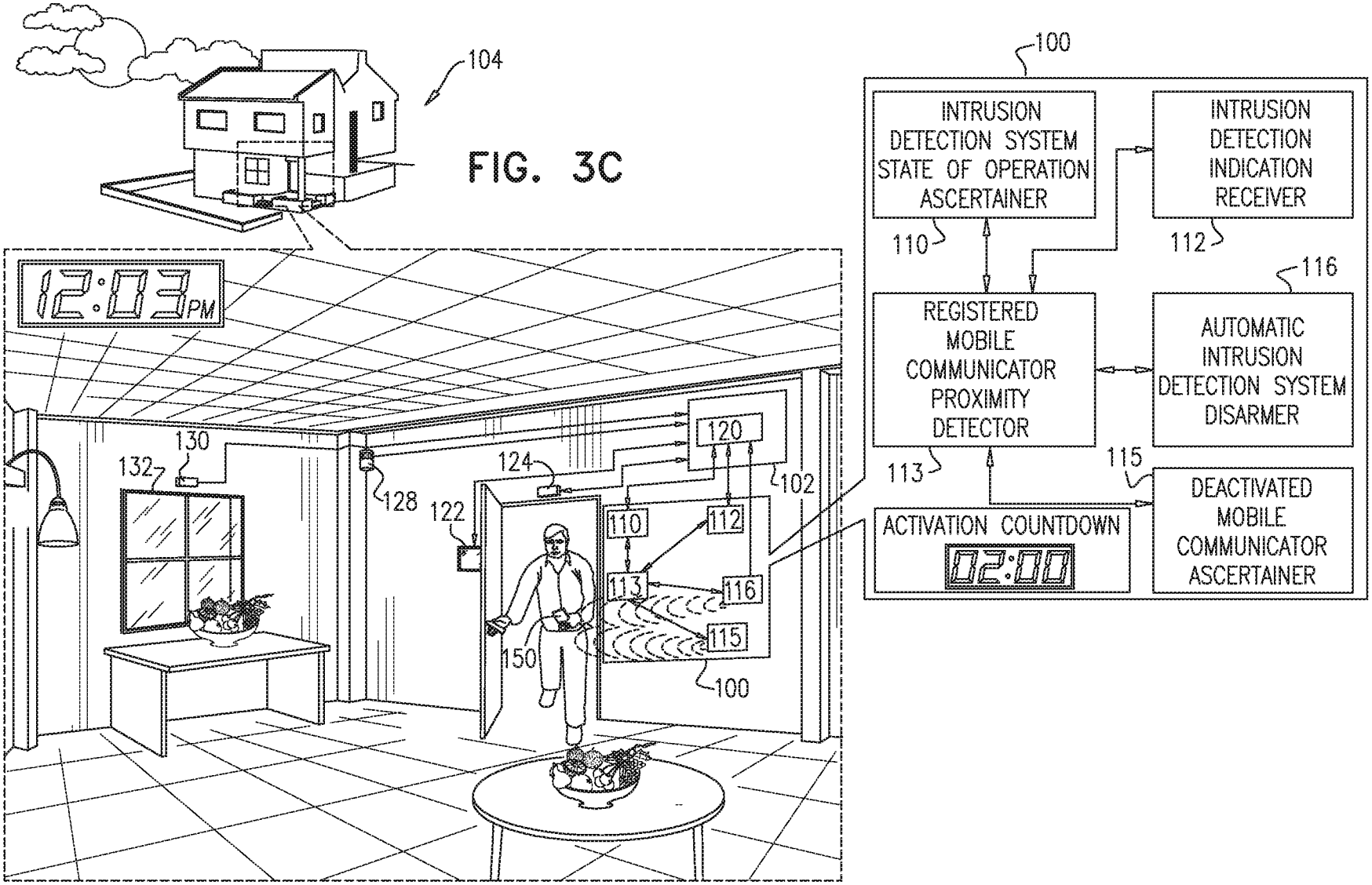

Turning now to the embodiment of FIGS. 3A-3C, it is shown in FIG. 3A that an individual holding a registered mobile communicator 150 initially approaches front door 126 from within premises 104 and, prior to exiting premises 104, preferably activates an armed state of operation of intrusion detection system 102 by employing, for example, user interface 122. Responsive to activation of the armed state of operation, intrusion detection system 102 preferably provides an indication of activation of the armed state of operation of intrusion detection system 102 to intrusion detection system state of operation ascertainer 110.

As described hereinabove, registered mobile communicator proximity detector 113, communicating with intrusion detection system state of operation ascertainer 110, is preferably operable, responsive to receiving the indication of activation of the armed state of operation of intrusion detection system 102 by intrusion detection system state of operation ascertainer 110, for initially deactivating registered mobile communicator 150. Thereafter, registered mobile communicator proximity detector 113 continuously ascertains, during a finite activation period of time, whether deactivated mobile communicator 150 is in a vicinity of premises 104 and, responsive to ascertaining that deactivated mobile communicator 150 is not in a vicinity of premises 104 during at least part of the finite activation period of time, for reactivating the deactivated mobile communicator. The finite activation period of time will typically be, for example, a short period of time lasting several minutes. It is appreciated that ascertaining, by mobile communicator proximity detector 113, whether registered mobile communicator 150 is in the vicinity of premises 104 preferably includes employing the Bluetooth Low Energy (BLE) wireless communication protocol to scan the vicinity of premises 104 for the presence of registered mobile communicator 150.

As illustrated in FIG. 3B, the individual then walks away from premises 104, and registered mobile communicator proximity detector 113, ascertains, during the finite activation period of time, that deactivated mobile communicator 150 is in no longer in the vicinity of premises 104 and therefore reactivates mobile communicator 150.

As further illustrated in FIG. 3C, at a later time but during the finite activation period of time, the individual realizes that he needs to return to premises 104 to fetch an item he has forgotten. It is a particular feature of this embodiment of the present invention that although the individual returns to premises during the finite activation period of time, activated mobile communicator 150 is operable to automatically disarm intrusion detection system 102, as will be described hereinbelow with regard to FIG. 4.

Figure 4:
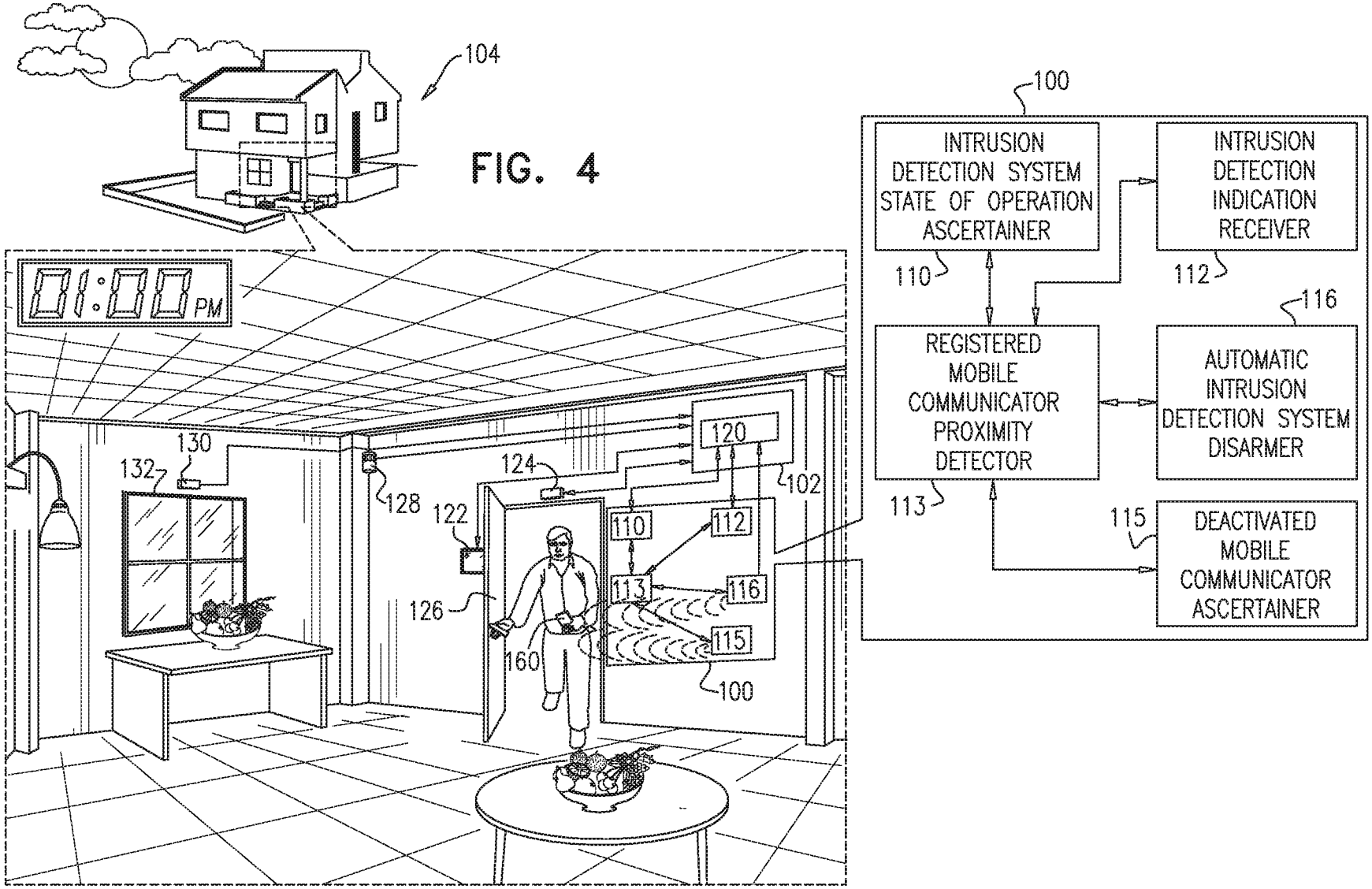
FIG. 4 is a simplified illustration of additional steps in the operation of the embodiments of the automatic intrusion system disarming system of FIGS. 1-3C.

Reference is now made to FIG. 4, which is a simplified illustration of additional steps in the operation of the embodiments of the automatic intrusion system disarming system of FIGS. 1-3C.

As shown in FIG. 4, it is shown that at a later time, after the finite activation period of time during which mobile communicator proximity detector 113 reactivated registered mobile communicators which were not found to be in the vicinity of premises 104, an individual approaches front door 126 of premises 104 and opens front door 126. As described hereinabove, the opening of front door 126 is preferably detected by sensor 124 mounted on front door 126. It is appreciated the individual opening door 126 may or may not be authorized to access premises 104.

Responsive to detecting opening of front door 126, sensor 124 preferably communicates an intrusion detection indication to intrusion detection system state of operation ascertainer 110 of automatic intrusion system disarming system 100, operable for receiving, from intrusion detection system 102, an indication of activation of an armed state of operation of intrusion detection system 102. It is appreciated that communication between sensor 124 and automatic intrusion system disarming system 100 may be wired. Alternatively, to obviate the need for wired connection between sensor 110 and automatic intrusion system disarming system 100, sensor 124 may be battery operated and may therefore employ a power-efficient wireless communication protocol when communicating with automatic intrusion system disarming system 100 such as, for example, the PowerG protocol.

In a case where intrusion detection system 102 is in the disarmed state of operation, intrusion detection system state of operation ascertainer 110 preferably ignores the intrusion detection indication of the opening of front door 126.

In a case where intrusion detection system 102 is in the armed state of operation, intrusion detection system state of operation ascertainer 110 preferably communicates the intrusion detection indication of the opening of front door 126 and an indication of the armed state of operation of intrusion detection system 102 to registered mobile communicator proximity detector 113. Responsive thereto, registered mobile communicator proximity detector 113 preferably ascertains whether at least one of the registered mobile communicators which is not a member of the deactivated subset of registered mobile communicators is in a vicinity of premises 104.

It is appreciated that ascertaining, by registered mobile communicator proximity detector 113, whether at least one of the multiplicity of registered mobile communicators which is not a member of the deactivated subset of registered mobile communicators is in a vicinity of premises 104, preferably includes employing the Bluetooth Low Energy (BLE) wireless communication protocol to scan the vicinity of premises 104 for the presence of a mobile communicator registered with registered mobile communicator proximity detector 113.

Responsive to ascertaining that a mobile communicator 160 registered with registered mobile communicator proximity detector 113, which mobile communicator 160 is not a member of the deactivated subset of registered mobile communicators, is in the vicinity of premises 104 and that intrusion detection system 102 is in the armed state of operation, registered mobile communicator proximity detector 113 preferably communicates, to automatic intrusion detection system disarmer 116, an instruction to automatically disarm intrusion detection system 102.

To automatically disarm intrusion detection system 102, automatic intrusion detection system disarmer 116 preferably establishes a Bluetooth Low Energy (BLE) wireless connection with mobile communicator 160, and communicates to mobile communicator 160 an indication that intrusion detection system 102 is in the armed state of operation. Responsive to receiving the indication that intrusion detection system 102 is in the armed state of operation, mobile communicator 160 preferably wirelessly communicates to automatic intrusion detection system disarmer 116, over the Bluetooth Low Energy (BLE) wireless connection, an instruction to disarm intrusion detection system 102. Responsive to receiving the instruction to disarm intrusion detection system 102, automatic intrusion detection system disarmer 116 preferably forwards to controller 120, over the PowerG wireless communication protocol, the instruction to disarm intrusion detection system 102.

Responsive to receiving, by controller 120, the instruction to disarm intrusion detection system 102, controller 120 preferably proceeds to disarm intrusion detection system 102. Responsive to the disarming of intrusion detection system 102 by controller 120, controller 120 preferably communicates to automatic intrusion detection system disarmer 116, over the PowerG wireless communication protocol, an indication of the disarming of intrusion detection system 102 by controller 120. Responsive to receiving the indication of the disarming of intrusion detection system 102 by controller 120, automatic intrusion detection system disarmer 116 preferably communicates to mobile communicator 160, over the Bluetooth Low Energy (BLE) wireless connection, the indication of the disarming of intrusion detection system 102 by controller 120.

It is appreciated that responsive to ascertaining that none of the multiplicity of mobile communicators registered with registered mobile communicator proximity detector 113, which are not members of the deactivated subset of registered mobile communicators, are in the vicinity of premises 104, registered mobile communicator proximity detector 113 is preferably operable for generating an intrusion indication indicative of an intrusion, and for communicating the intrusion indication to controller 120. Controller 120 then, in turn, typically generates and alarm indication which, for example, is communicated to an operator of intrusion detection system 102.

It is appreciated that automatic intrusion system disarming system 100 may be embedded in sensor 124, which is typically battery-powered and it is therefore imperative for automatic intrusion system disarming system 100 to employ power efficient methods of communication. It is therefore appreciated that automatic intrusion system disarming system 100 preferably communicates with controller 120 over a power-efficient wireless communication protocol such as, for example, the PowerG protocol. It is further appreciated, however, that commercially available mobile communicators are typically incapable of communicating over the PowerG protocol. Therefore, in the interest of power efficiency, registered mobile communicator proximity detector 113 is preferably operable to scan the vicinity of premises 104 for the presence of a mobile communicator registered with registered mobile communicator proximity detector 113 and to communicate with a registered mobile communicator over the Bluetooth Low Energy (BLE) wireless communication protocol only in response to detecting opening of door 126 and to ascertaining that intrusion detection system 102 is in the armed state of operation.

Figure 5A:
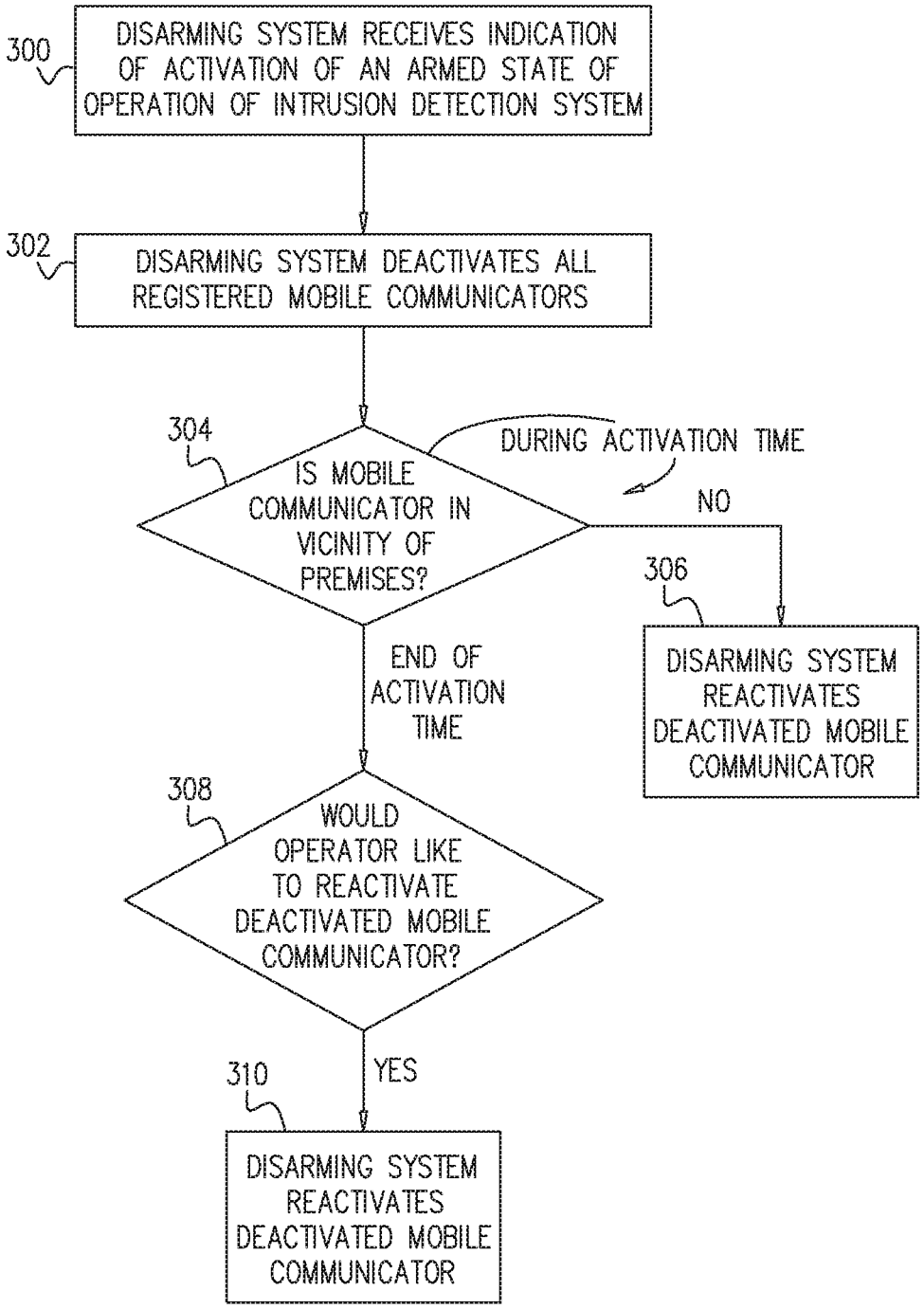
FIGS. 5A and 5B are together a simplified flowchart indicating steps in the operation of the automatic intrusion system disarming system of FIGS. 1-4.
Figure 5B:
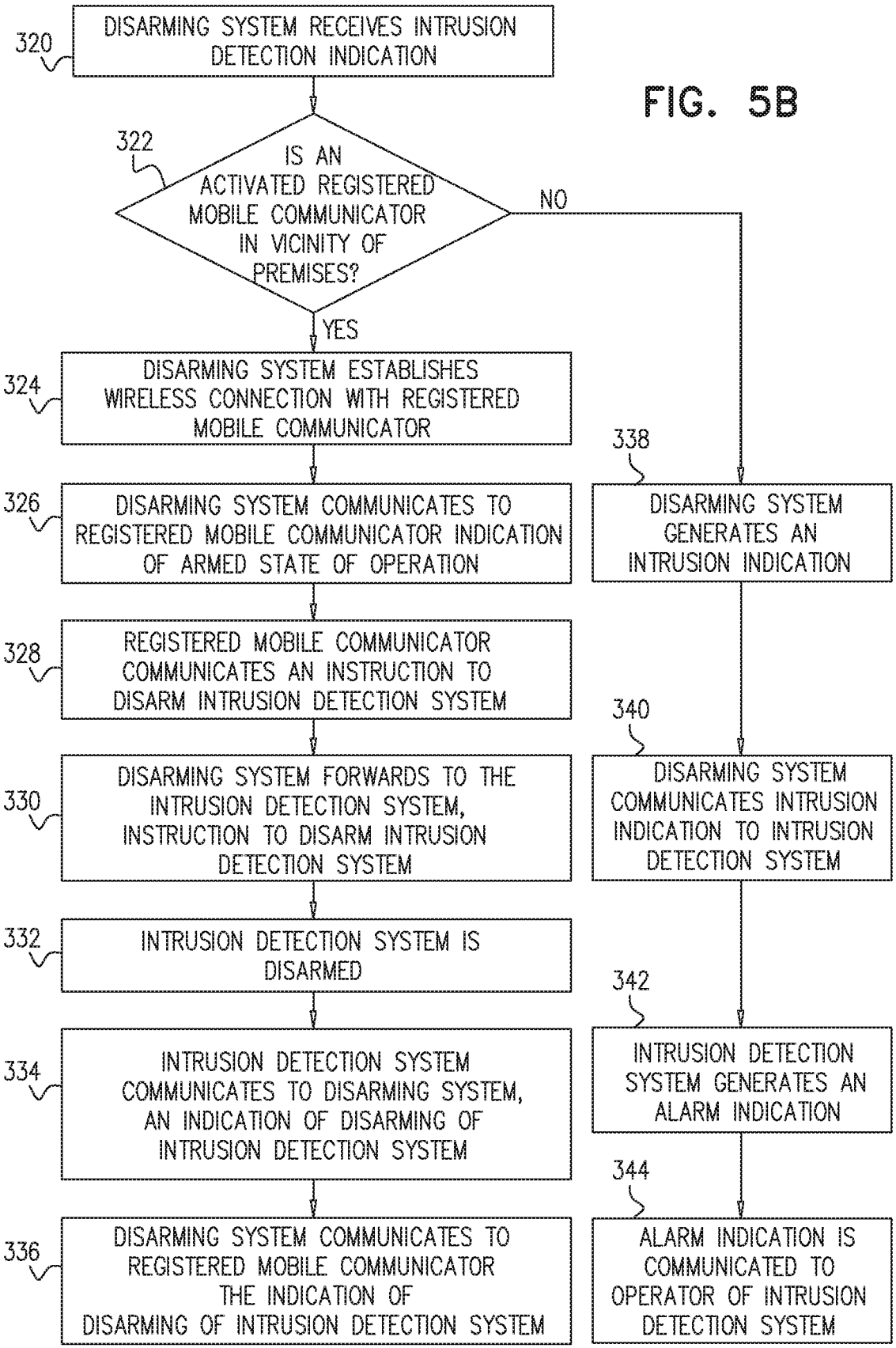

Reference is now made to FIGS. 5A and 5B, which are together a simplified flowchart indicating steps in the operation of the automatic intrusion system disarming system of FIGS. 1-4. As described hereinabove with reference to FIGS. 1-4, the automatic intrusion system disarming system is preferably operable for automatically disarming an intrusion detection system protecting a premises, the intrusion detection system preferably having at least an armed state of operation and a disarmed state of operation.

As shown in FIG. 5A, the automatic intrusion system disarming system initially receives an indication of activation of an armed state of operation of an intrusion detection system from the intrusion detection system (300). It is appreciated that to obviate the need for wired connection between the automatic intrusion system disarming system and the intrusion detection system, the automatic intrusion system disarming system is typically battery operated and therefore preferably employs a power-efficient wireless communication protocol when communicating with the intrusion detection system such as, for example, the PowerG protocol. It is appreciated that mobile communicators of individuals authorized to access the premises are preferably pre-registered with the automatic intrusion system disarming system, for example, via Bluetooth Low Energy (BLE) bonding with the automatic intrusion system disarming system.

Responsive to receiving the indication of activation of an armed state of operation, the automatic intrusion system disarming system preferably ascertains at least a subset of a multiplicity of registered mobile communicators which are located in a vicinity of the premises during a finite activation period of time starting at the receipt of the indication of the activation of the armed state of operation of the intrusion detection system, and deactivates the subset of the multiplicity of registered mobile communicators as follows:

Responsive to receiving the indication of activation of the armed state of operation of the intrusion detection system, the automatic intrusion system disarming system preferably deactivates all of the registered mobile communicators (302). The automatic intrusion system disarming system then continuously ascertains, during the finite activation period of time, for each deactivated mobile communicator, whether the deactivated mobile communicator is in a vicinity of the premises (304). Ascertaining whether a deactivated mobile communicator is in a vicinity of the premises during the activation time of the armed state of operation preferably includes employing the Bluetooth Low Energy (BLE) communication protocol to scan the vicinity of the premises for the deactivated mobile communicator.

Responsive to ascertaining that a deactivated mobile communicator is not in a vicinity of the premises during at least part of the finite activation period of time, the automatic intrusion system disarming system then reactivates the deactivated mobile communicator (306).

Additionally, at the end of the finite activation period of time, the automatic intrusion system disarming system preferably queries an operator of each deactivated mobile communicator of the deactivated subset of multiplicity of registered mobile communicators whether to reactivate the deactivated mobile communicator (308) and responsive to receiving confirmation from the operator of the deactivated mobile communicator, reactivates the deactivated mobile communicator (310).

Turning now to FIG. 5B, it is shown that at a later time, while the intrusion detection system is in the armed state of operation, the automatic intrusion system disarming system receives an indication of detection of an intrusion to said premises from the intrusion detection system, such as opening of the front door of the premises (320). It is appreciated that the intrusion is preferably detected by at least one sensor of the intrusion detection system. The sensor may be, for example, a door contact sensor mounted on the front door. It is further appreciated that intrusion indications received by the automatic intrusion system disarming system while the intrusion detection system is in the disarmed state of operation are typically ignored by the automatic intrusion system disarming system.

Responsive to receiving the indication of detection of an intrusion to said premises from the intrusion detection system, the automatic intrusion system disarming system preferably ascertains whether at least one of a multiplicity of registered mobile communicators which is not a member of the deactivated subset of registered mobile communicators is in a vicinity of the premises (322). As described hereinabove, it is appreciated that mobile communicators of individuals authorized to access the premises are preferably pre-registered with the automatic intrusion system disarming system, for example, via Bluetooth Low Energy (BLE) bonding with the automatic intrusion system disarming system. Accordingly, ascertaining, by the automatic intrusion system disarming system, whether at least one of a multiplicity of registered mobile communicators which is not a member of the deactivated subset of registered mobile communicators is in a vicinity of the premises preferably includes employing the Bluetooth Low Energy (BLE) wireless communication protocol to scan the vicinity of the premises for the presence of a registered mobile communicator which is not a member of the deactivated subset of registered mobile communicators.

Responsive to ascertaining that at least one registered mobile communicator, which is not a member of the deactivated subset of registered mobile communicators, is in the vicinity of the premises, the automatic intrusion system disarming system preferably automatically disarms the intrusion detection system as follows:

Initially, the automatic intrusion system disarming system establishes a Bluetooth Low Energy (BLE) wireless connection with the registered mobile communicator (324). Thereafter, the automatic intrusion system disarming system preferably communicates to the registered mobile communicator, an indication that the intrusion detection system is in the armed state of operation (326).

Responsive to receiving the indication that the intrusion detection system is in the armed state of operation, the registered mobile communicator preferably communicates to the automatic intrusion system disarming system, over the Bluetooth Low Energy (BLE) connection, an instruction to disarm the intrusion detection system (328). Responsive to receiving the instruction to disarm the intrusion detection system, the automatic intrusion system disarming system preferably forwards to the intrusion detection system, over the PowerG protocol, the instruction to disarm the intrusion detection system (330).

Responsive to receiving, by the intrusion detection system, the instruction to disarm the intrusion detection system, the intrusion detection system is disarmed (332). Responsive to disarming of the intrusion detection system, the intrusion detection system preferably communicates to the automatic intrusion system disarming system, over the PowerG protocol, an indication of the disarming of the intrusion detection system (334). Thereafter, the automatic intrusion system disarming system preferably communicates to the registered mobile communicator over the Bluetooth Low Energy (BLE) connection, the indication of the disarming of the intrusion detection system (336).

Responsive to ascertaining that none of the registered mobile communicators which not members of the deactivated subset of registered mobile communicators are in the vicinity of the premises, the automatic intrusion system disarming system preferably generates an intrusion indication indicative of an intrusion (338), and preferably communicates the intrusion indication to the intrusion detection system (340). The intrusion detection system then, in turn, typically generates an alarm indication (342) which, for example, is then communicated to an operator of the intrusion detection system (344).

It will be appreciated by persons skilled in the art that the present invention is not limited by what has been particularly shown and described hereinabove. Rather the scope of the present invention includes both combinations and subcombinations of the various features described hereinabove as well as modifications thereof which would occur to persons skilled in the art upon reading the foregoing description and which are not in the prior art.

The invention claimed is:

1. A system for automatically disarming an intrusion detection system protecting a premises and having an armed state of operation and a disarmed state of operation, comprising:

an intrusion detection system state of operation ascertainer operable for receiving an indication of an activation of the armed state of operation of the intrusion detection system;

an intrusion detection indication receiver operable for receiving an indication of a detection of an intrusion to the premises;

a registered mobile communicator proximity detector operable, responsive to the activation of the armed state of operation, for initially deactivating all of a multiplicity of registered mobile communicators and then reactivating one or more registered mobile communicators which are not located in a vicinity of the premises during an activation time of the armed state of operation;

the registered mobile communicator proximity detector further operable, responsive to the activation of the armed state of operation and to the detection of the intrusion to the premises, for ascertaining whether at least one of the one or more registered mobile communicators is in the vicinity of the premises; and an automatic intrusion detection system disarmer operable, responsive to the at least one of the one or more registered mobile communicators being in the vicinity of the premises, for automatically disarming the intrusion detection system.

2. The system of claim 1, wherein the registered mobile communicator proximity detector is further operable, responsive to the activation of the armed state of operation, for:

ascertaining that at least a subset of the multiplicity of registered mobile communicators are located in the vicinity of the premises during the activation time of the armed state of operation; and deactivating the subset of the multiplicity of registered mobile communicators.

3. The system of claim 2, wherein the registered mobile communicator proximity detector is also operable, responsive to the activation of the armed state of operation and to the detection of the intrusion to the premises, for ascertaining whether at least one of the multiplicity of registered mobile communicators which is not a member of the subset of the multiplicity of registered mobile communicators is in the vicinity of the premises.

4. The system of claim 3, wherein the automatic intrusion detection system disarmer is further operable for automatically disarming the intrusion detection system responsive to:

the activation of the armed state of operation;

the detection of the intrusion to the premises; and the at least one of the multiplicity of registered mobile communicators which is not the member of the subset of the multiplicity of registered mobile communicators being in the vicinity of the premises.

5. The system of claim 2, wherein the activation time of the armed state of operation comprises a finite activation period of time starting at the receiving of the indication of the activation of the armed state of operation.

6. The system of claim 2, wherein the registered mobile communicator proximity detector is further operable for:

continuously ascertaining, during the activation time, for each deactivated mobile communicator, whether the deactivated mobile communicator is in the vicinity of the premises; and responsive to ascertaining that the deactivated mobile communicator is not in the vicinity of the premises during at least a part of the activation time, for reactivating the deactivated mobile communicator.

7. The system of claim 2, further comprising a deactivated mobile communicator ascertainer operable for:

querying, at an end of the activation time, an operator of each deactivated mobile communicator in the subset of the multiplicity of registered mobile communicators, whether to reactivate the deactivated mobile communicator; and responsive to receiving confirmation from the operator of the deactivated mobile communicator, for reactivating the deactivated mobile communicator.

8. The system of claim 3, wherein the registered mobile communicator proximity detector is further operable for generating an intrusion indication indicative of the intrusion, responsive to:

the detection of the intrusion to the premises in the armed state of operation; and ascertaining that none of the multiplicity of registered mobile communicators which are not members of the subset of the plurality of registered mobile communicators are in the vicinity of the premises.

9. The system of claim 3, wherein the receiving of the indication of the activation of the armed state of operation comprises communicating between the intrusion detection system and the intrusion detection system state of operation ascertainer over the PowerG communication protocol.

10. The system of claim 2, wherein the multiplicity of registered mobile communicators are registered with the registered mobile communicator proximity detector via Bluetooth Low Energy (BLE) bonding; and wherein the ascertaining that the at least the subset of the multiplicity of registered mobile communicators which are located in the vicinity of the premises during the activation time comprises employing, by the registered mobile communicator proximity detector, the BLE communication protocol to scan the vicinity of the premises for the multiplicity of registered mobile communicators.

11. The system of claim 3, wherein the multiplicity of registered mobile communicators are registered with the mobile communicator proximity detector via Bluetooth Low Energy (BLE) bonding; and wherein the ascertaining of whether the at least one of the multiplicity of registered mobile communicators which is not the member of the subset of the multiplicity of registered mobile communicators is in the vicinity of the premises comprises employing, by the registered mobile communicator proximity detector, the BLE communication protocol to scan the vicinity of the premises for the multiplicity of registered mobile communicators which are not members of the subset of the multiplicity of registered mobile communicators.

12. The system of claim 4, wherein the automatically disarming comprises:

establishing a connection between the automatic intrusion detection system disarmer and the at least one of the multiplicity of registered mobile communicator which is not the member of the subset of the multiplicity of registered mobile communicators;

communicating, by the automatic intrusion detection system disarmer to the at least one of the multiplicity of registered mobile communicators, an indication that the intrusion detection system is in the armed state of operation;

responsive to receiving the indication that the intrusion detection system is in the armed state of operation, communicating, by the at least one of the multiplicity of registered mobile communicator to the automatic intrusion detection system disarmer, an instruction to disarm the intrusion detection system; and responsive to receiving the instruction to disarm the intrusion detection system by the automatic intrusion detection system disarmer, forwarding, by the automatic intrusion detection system disarmer to the intrusion detection system, the instruction to disarm the intrusion detection system.

13. The system of claim 12, wherein the automatically disarming further comprises:

responsive to receiving, by the intrusion detection system, the instruction to disarm the intrusion detection system, disarming the intrusion detection system by the intrusion detection system;

responsive to the disarming, communicating, by the intrusion detection system to the automatic intrusion detection system disarmer, an indication of the disarming of the intrusion detection system; and forwarding, by the automatic intrusion detection system disarmer to the at least one of the multiplicity of registered mobile communicators, the indication of the disarming.

14. The system of claim 13, wherein the connection between the automatic intrusion detection system disarmer and the at least one of the multiplicity of registered mobile communicators which is not the member of the subset of the multiplicity of registered mobile communicators is a Bluetooth Low Energy (BLE) connection.

15. The system of claim 13, wherein the communicating, between the at least one of the multiplicity of registered mobile communicators and the automatic intrusion detection system disarmer, is over the PowerG protocol.

16. A method for automatically disarming an intrusion detection system protecting a premises and having an armed state of operation and a disarmed state of operation, comprising:

receiving an indication of an activation of the armed state of operation of the intrusion detection system;

receiving an indication of a detection of an intrusion to the premises;

responsive to the activation of the armed state of operation, initially deactivating all of a multiplicity of registered mobile communicators and then reactivating one or more of the multiplicity of registered mobile communicators which are not located in a vicinity of the premises during an activation time of the armed state of operation; and responsive to the activation of the armed state of operation and the detection of the intrusion to the premises:

ascertaining whether at least one of the one or more of the multiplicity of registered mobile communicators is in the vicinity of the premises; and responsive to the at least one of the one or more of the multiplicity of registered mobile communicators being in the vicinity of the premises, automatically disarming the intrusion detection system.

17. The method of claim 16, further comprising:

responsive to the activation of the armed state of operation:

ascertaining that at least a subset of the multiplicity of registered mobile communicators are located in the vicinity of the premises during an activation time of the armed state of operation; and deactivating the subset of the multiplicity of registered mobile communicators.

18. The method of claim 17, further comprising, responsive to the activation of the armed state of operation and the detection of the intrusion to the premises, ascertaining whether at least one of the multiplicity of registered mobile communicators which is not a member of the subset of the multiplicity of registered mobile communicators is in the vicinity of the premises.

19. The method of claim 18, further comprising automatically disarming said intrusion detection system responsive to:

the activation of the armed state of operation;

the detection of the intrusion to the premises; and the at least one of the multiplicity of registered mobile communicators which is not the member of the subset of the multiplicity of registered mobile communicators being in the vicinity of the premises.

20. The method of claim 17, wherein the activation time of the armed state of operation comprises a finite activation period of time starting at the receiving of the indication of the activation of the armed state of operation of the intrusion detection system.

21. The method of claim 17, wherein the deactivating of the subset of the multiplicity of registered mobile communicators comprises:

continuously ascertaining, during the activation time, for each deactivated mobile communicator, whether the deactivated mobile communicator is in the vicinity of the premises; and responsive to ascertaining that the deactivated mobile communicator is not in the vicinity of the premises during at least a part of the activation time, reactivating the deactivated mobile communicator.

22. The method of claim 17, further comprising;

querying, at an end of the activation time, an operator of each deactivated mobile communicator of the subset of the multiplicity of registered mobile communicators whether to reactivate the deactivated mobile communicator; and responsive to receiving confirmation from the operator of the deactivated mobile communicator, reactivating the deactivated mobile communicator.

23. The method of claim 18, further comprising generating an intrusion indication indicative of the intrusion responsive to:

the detection of the intrusion to the premises in the armed state of operation; and ascertaining that none of the multiplicity of registered mobile communicators which are not members of the subset of the plurality of registered mobile communicators are in the vicinity of the premises.

24. The method of claim 17, wherein the receiving of the indication of the activation of the armed state of operation comprises communicating, by the intrusion detection system, a state of operation of the intrusion detection system over the PowerG communication protocol.

25. The method of claim 17, wherein the multiplicity of registered mobile communicators are registered via Bluetooth Low Energy (BLE) bonding; and wherein the ascertaining said that the at least the subset of the multiplicity of registered mobile communicators which are located in the vicinity of the premises during the activation time of the armed state of operation comprises employing the BLE communication protocol to scan the vicinity of the premises for the multiplicity of registered mobile communicators.

26. The method of claim 18, wherein the multiplicity of registered mobile communicators are registered via Bluetooth Low Energy (BLE) bonding; and wherein the ascertaining whether the at least one of the multiplicity of registered mobile communicators which is not the member of the subset of the multiplicity of registered mobile communicators is in the vicinity of the premises comprises employing the BLE communication protocol to scan the vicinity of the premises for the multiplicity of registered mobile communicators which are not members of the subset of the multiplicity of registered mobile communicators.

27. The method of claim 19, wherein the automatically disarming comprises:

establishing a connection with at least one of the multiplicity of registered mobile communicators which is not the member of the subset of the multiplicity of registered mobile communicators;

communicating to the at least one of the multiplicity of registered mobile communicator, over the connection, an indication that the intrusion detection system is in the armed state of operation;

responsive to receiving the indication that the intrusion detection system is in the armed state of operation, communicating, by the at least one of said multiplicity of registered mobile communicator, over the connection, an instruction to disarm the intrusion detection system; and responsive to receiving the instruction to disarm the intrusion detection system, forwarding, to the intrusion detection system, the instruction to disarm the intrusion detection system.

28. The method of claim 27, wherein the automatically disarming further comprises:

responsive to receiving, by the intrusion detection system, the instruction to disarm the intrusion detection system, disarming the intrusion detection system;

responsive to the disarming, communicating, by the intrusion detection system, an indication of the disarming of the intrusion detection system; and forwarding, to the at least one of the multiplicity of registered mobile communicators, over the connection, the indication of the disarming of the intrusion detection system.

29. The method of claim 28, wherein the connection with the at least one of the multiplicity of registered mobile communicators which is not the member of the subset of the multiplicity of registered mobile communicators is a Bluetooth Low Energy (BLE) connection.

30. The method of claim 28, wherein the communication with the intrusion detection system is over the PowerG protocol.

* * * * *